United States Patent [19]

van der Wouden

[11] Patent Number: 4,574,482

[45] Date of Patent: Mar. 11, 1986

[54] TIN OPENER

[76] Inventor: Adriaan van der Wouden, Dorpstraat 25, 4851 CJ Ulvenhout, Netherlands

[21] Appl. No.: 504,316

[22] Filed: Jun. 14, 1983

[30] Foreign Application Priority Data

Jun. 17, 1982 [NL] Netherlands ..... 8202461

[51] Int. Cl.[4] ..... B67B 7/54

[52] U.S. Cl. ..... 30/422; 30/426; 74/89; 74/436

[58] Field of Search ..... 30/421, 422, 424, 426, 30/419; 7/152-154; 74/436, 89

[56] References Cited

U.S. PATENT DOCUMENTS 4,046,027 9/1977 Rudszinat ..... 74/436 X 4,365,417 12/1982 Rosandahl ..... 30/422

*Primary Examiner*—Douglas D. Watts

*Attorney, Agent, or Firm*—Birch, Stewart, Kolasch & Birch

[57] ABSTRACT

A tin opener mainly comprising a housing (1), a drive shaft (2) rotatably arranged in the housing (1) for a transport wheel (3) located outside the housing (1), a body (7) rotatably arranged about a second shaft (A—A) parallel to the driving shaft in the housing (1) for supporting a cutting wheel (1) rotatable about a third shaft, the third shaft being at an angle of the second shaft, wherein the body is provided with a radial slot (13) whereas a lug (6) moved by the driving shaft (2) in a circular path and being displaceable with respect thereto, is adapted to be, each time, introduced into a slot (13) through an angle in order to minimize the force required to penetrate into the tin, that is to cut into the tin cover at the beginning of the cutting cycle.

3 Claims, 10 Drawing Figures

TIN OPENER

BACKGROUND OF THE INVENTION

The invention relates to a tin opener mainly comprising a housing, a drive shaft rotatably arranged in the housing for a transport wheel located outside the housing, a body rotatably arranged about a second shaft parallel to the driving shaft in the housing for supporting a cutting wheel rotatable about a third shaft, the third shaft being at an angle with the second shaft, while transmission members are arranged in the housing between the driving shaft and the body.

In a tin opener of the kind set forth the rotation of the drive shaft of the transport wheel causes the cutting wheel to get into the working position and, conversely, the cutting wheel to return to the rest position when the direction of rotation of the drive shaft is reversed. In this way a so-called one-grip tin opener is provided.

SUMMARY OF THE INVENTION

The invention has as an object to minimize the force required to penetrate the tin, that is to cut into the tin cover at the beginning of the cutting cycle. Furthermore, the invention has for its object to provide simple, yet effective transmission members so that a long lifetime is ensured.

The opener embodying the present invention is distinguished in that the transmission members are designed in the form of a radial slot in the body and a lug is moved by the driving shaft, in a circular path being displaced with respect thereto, the lug being, introduced into the slot for turning the body of the cutting wheel through an angle.

Owing to the relative displacement of the lug with respect to the drive shaft continued rotation of the drive shaft is possible, without the need for further means, even after the cutting wheel has reached its working position.

The relative displacement of the lug with respect to the shaft may be designed in various ways, for example, by means of a friction coupling.

In a preferred embodiment, however, the body is provided near the slot with a ramp, while the lug is arranged on a non-rotatable disk which is displaceable with respect to the drive shaft. Therefore, when the drive shaft is turned, the lug can deflect on the ramp because the disk shifts in place with respect to the drive shaft, as a result of which unlimited rotational movement of the shaft is ensured. In order to ensure that due to an unexpected movement of the tin opener when the cut is made the cutting wheel will not shift in place, the drive shaft is provided with a rotatable, arcuate circumferential face co-operating with a correspondingly shaped circumferential face of the body, will the body furthermore has a stop face co-operating with a lug fixedly arranged in the housing. Thus the body is protected against rotation in the working position of the cutting wheel.

When the ramp of the preferred embodiment is used, the body is provided on the side, remote from the cutting wheel, with a second arcuate circumferential face which co-operates with the circumferential face of the displaceable cam disk which takes over the blocking of the body for the cutting wheel as soon as the lug is passed along the body.

BRIEF DESCRIPTION OF DRAWINGS

The invention will be described more fully with reference to an embodiment shown in the drawing.

The drawing shows in:

In FIG. 1 a bipartite housing 1 that can be taken in hand or is arranged in a frame, a drive shaft 2 is rotatably journalled, to the right-hand end of which is rigidly secured a transport wheel 3. Between the transport wheel and the housing is arranged a gear wheel 4. Around the shaft 2 a non-rotatable disk-shaped element 5 is provided freely movable in an axial direction with respect to the shaft 2 and provided with two diametrically opposite lugs 6.

Figure 1:
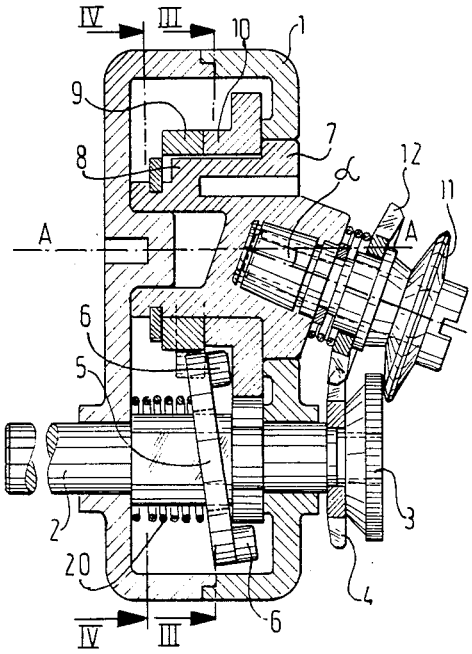
FIG. 1 a vertical sectional view of the tin opener embodying the invention.

Above the shaft 2 a body 7 is arranged in the housing so as to be rotatable about a second shaft A—A, the body being provided with a wedge 8 about which two disk-shaped elements 9 and 10 are non-rotatably arranged on the body. In the body a third rotary shaft of the cutting wheel 11 is arranged at an angle to the line A—A and provided with a gear wheel 12 which meshes with the gear wheel 4.

The mechanism shown in the housing serves to move the cutting wheel 11 upon rotation of the shaft 2 or the transport wheel 3 respectively from an angular position in which the cutting wheel 11 is free of the transport wheel 3 into a different angular position in which it is in the position shown in FIG. 1. In other words, FIG. 1 shows the cutting position of the device. This is attained by returning the shaft 2 to the right.

Figure 2:
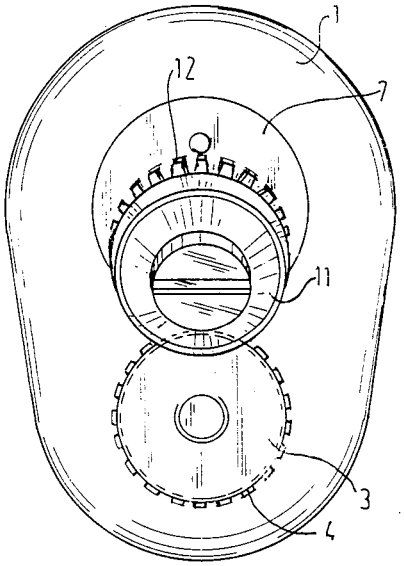
FIG. 2 an elevational view of the tin opener of FIG. 1.
Figure 3:
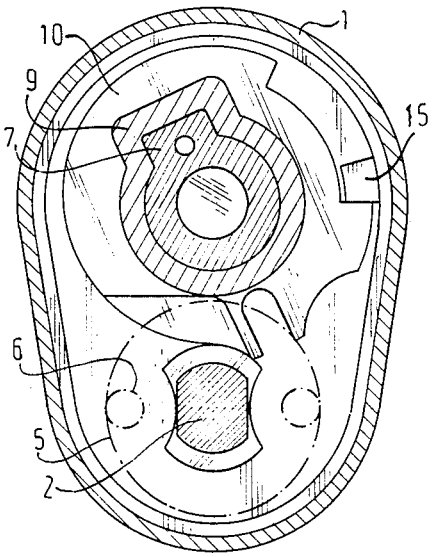
FIGS. 3 and 4 are sectional views taken along the lines III—III and IV—IV respectively in FIG. 1, FIGS. 5*a*, 5*b* and 5*c* represent different positions of the parts in the tin opener with respect to a sectional view of FIG. 3, and FIGS. 6*a*, 6*b* and 6*c* represent different positions of the parts in accordance with a sectional view of FIG. 4.
Figure 5A:
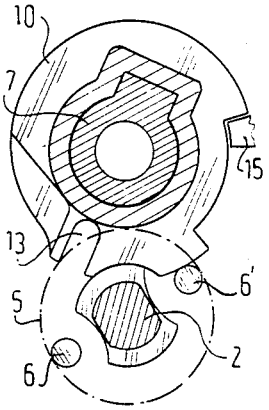
Figure 5B:
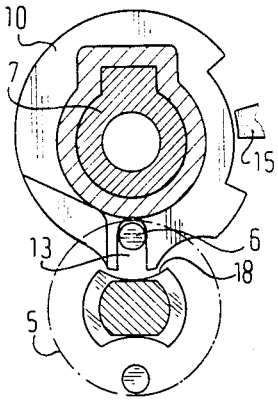
Figure 5C:
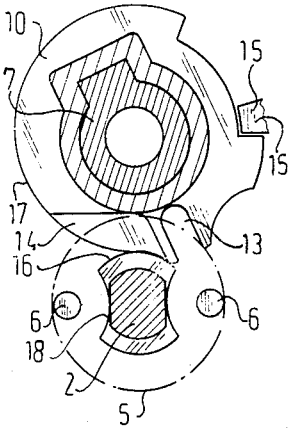

Referring to FIGS. 2, 3 and 5 the one free position of the cutting wheel 11 is taken as a base, in which the rim of a tin (not shown) can be placed on the transport wheel 3. By turning the shaft 2 to the right in FIG. 5*a* by means of a handle (not shown) or a motor, the lug 6 will displace the element 10 via a slot 13 in the element in anti-clockwise direction from a position as shown in FIG. 5*b* into a position as shown in FIG. 5*c*. Continued rotation of the shaft 2 in the clockwise direction is possible without a further turn of the body 7 connected with the element 10 because the element 10 has a ramp 14 with which the lugs 6 and 6 come into contact so that the disk 5 obliquely tilts away (see FIG. 1). The body 7 is retained by the stop 15 in the housing 1 so that the cutting wheel 11 remains in the cutting position. Turning back the body 7 and wheel 11 is then not possible owing to the circumferential face 16 on a thickened part of the driving shaft 2 being in contact with the circumferential face 17 of the body 7.

Figure 4:
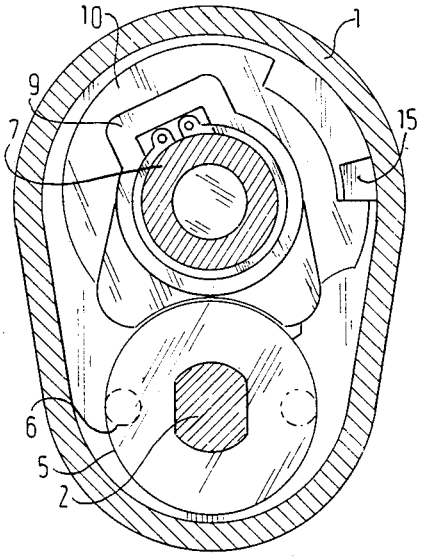
Figure 6A:
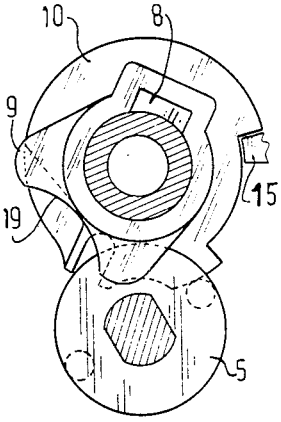
Figure 6B:
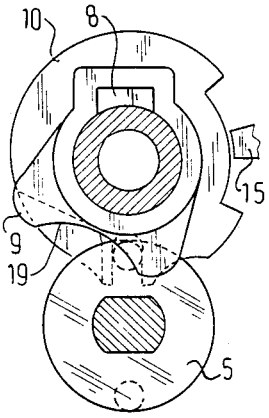
Figure 6C:
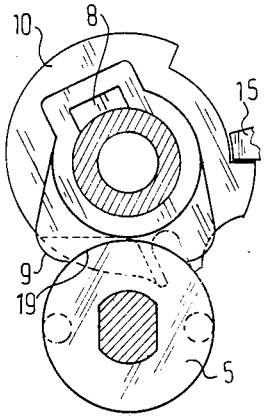

At two diametrically opposite points opposite the lugs 6 the circumferential face 16 is interrupted by reentrant parts 18 which serve to release the circumferential rim at the slot 13 of the disk 10 (see FIG. 5*b*). During the rising movement illustrated in FIG. 5*c* the blocking of the body 7 would be discontinued, but this blocking is taken over by the tilting movement of the disk 5 by the lug 6 so that the circumferential face of the disk 5 is pressed into the recess 19 of the body 9 (see FIGS. 4 and 6). As soon as lug 6 snaps back into the slot 13 upon a further turn of the shaft 2 as a result of the action of a spring 20 (see FIG. 1), the circumferential face 16 of the shaft 2 takes over the blocking situation.

For releasing the cutting wheel 11 from the tin, the shaft 2 has to be turned in an anti-clockwise direction so that lug 6 turns in clockwise direction via the slot 13 with the disk part 10 and hence the body 7 (see FIG. 5*a*). Lug 6' prevents a further return movement of the shaft 2.

The effect of the cutting wheel 11 and the transport wheel 3 on the tin is considered to be known.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A tin opener comprising a housing, a drive shaft rotatably arranged therein for transport wheel located outside of said housing, a body arranged in said housing so as to be rotatable about a second shaft parallel to said drive shaft for supporting a cutting wheel freely rotatable about a third shaft, which is set at a prescribed angle to said second shaft, transmission members arranged in said housing, said transmission members being designed in the form of a radially directed slot in the body and a first lug moved by said drive shaft along a circular path and being displaceable laterally with respect to said shaft such that said lug upon entering into the slot displaces said body through the arc, said body being provided with a ramp juxtapositioned to said slot and said first lug being arranged on a non-rotatable cam disc displaceable with respect to said drive shaft.

2. The tin opener of claim 1 wherein said drive shaft is provided with a rotatable, arcuate circumferential face cooperating with a correspondingly shaped circumferential face of a non-rotatable disk-shaped element of the body, said body being furthermore provided with a stop face fixedly arranged in said housing and cooperating with a second lug.

3. The tin opener of claim 1, wherein on a remote side from the cutting wheel, the body is provided with an arcuate circumferential face which cooperates with a circumferential rim of the displaceable cam disk.

* * * * *